US009950246B2

(12) United States Patent
Lysowski et al.

(10) Patent No.: US 9,950,246 B2
(45) Date of Patent: Apr. 24, 2018

(54) COLOR SIDE BETS IN BACCARAT

(71) Applicant: Caesars Enterprise Services, LLC, Las Vegas, NV (US)

(72) Inventors: John Lysowski, Las Vegas, NV (US); Nathan Ronald Armogan, Las Vegas, NV (US)

(73) Assignee: CEASARS ENTERPRISE SERVICES, LLC, Las Vegas, NV (US)

( * ) Notice: Subject to any disclaimer, the term of this patent is extended or adjusted under 35 U.S.C. 154(b) by 136 days.

(21) Appl. No.: 14/996,106

(22) Filed: Jan. 14, 2016

(65) Prior Publication Data

US 2017/0203198 A1 Jul. 20, 2017

(51) Int. Cl.

| | |
|---|---|
| ***A63F 1/00*** | (2006.01) |
| ***A63F 3/00*** | (2006.01) |
| ***G07F 17/32*** | (2006.01) |

(52) U.S. Cl.

CPC ..... *A63F 1/00* (2013.01); *A63F 3/00157* (2013.01); *G07F 17/3293* (2013.01); *A63F 2001/001* (2013.01)

(58) Field of Classification Search

None

See application file for complete search history.

(56) References Cited

U.S. PATENT DOCUMENTS

| | | | | |
|---|---|---|---|---|
| 5,362,064 | A | 11/1994 | Lofink et al. | |
| 6,523,831 | B2 | 2/2003 | Webb | |
| 7,419,160 | B1 | 9/2008 | D'Ambrosio | |
| 8,292,299 | B1 * | 10/2012 | Chartrand | G07F 17/3293 273/292 |
| 8,308,542 | B2 | 11/2012 | Daines | |
| 8,573,597 | B1 | 11/2013 | Oh | |
| 2008/0006996 | A1 * | 1/2008 | Frankel | G07F 17/32 273/142 R |
| 2008/0207292 | A1 * | 8/2008 | Yoshizawa | G07F 17/32 463/12 |
| 2009/0020952 | A1 | 1/2009 | Moody et al. | |

(Continued)

FOREIGN PATENT DOCUMENTS

| | | | |
|---|---|---|---|
| JP | 2008-005990 | A | 1/2008 |
| KR | 10-1035901 | B1 | 5/2011 |

OTHER PUBLICATIONS

Galaxy Gaming, Inc., "Lucky Win Baccarat," Date Unknown, 1 page. [Online] [Retrieved Aug. 9, 2016] Retrieved from the Internet <http://www.galaxygaming.com/galaxy-games/194/lucky-win-baccarat>.

(Continued)

*Primary Examiner* — Milap Shah
*Assistant Examiner* — Robert T Clarke, Jr.
(74) *Attorney, Agent, or Firm* — Greenberg Traurig, LLP

(57) ABSTRACT

A method, gaming machine, and online gaming system for playing a game of baccarat with a color side bet that the number of cards of a selected suit color in either the Player hand or the Banker hand will exceed the number of similarly colored cards in the other hand. After the regular baccarat hand is played, the Banker hand and the Player hand are compared with respect to the number of cards of the selected color and the outcome of the color side bet is determined based on which hand contains more cards of the selected color. A gaming table is configured the specific areas for receiving the color side bet.

9 Claims, 6 Drawing Sheets

(56) References Cited

U.S. PATENT DOCUMENTS

| | | | | |
|---|---|---|---|---|
| 2010/0187759 | A1 | 7/2010 | Farrow | |
| 2012/0165090 | A1 | 6/2012 | Duffy | |
| 2013/0225276 | A1 | 8/2013 | Au-Yeung | |
| 2013/0316776 | A1 | 11/2013 | Mendicino | |
| 2013/0324232 | A1* | 12/2013 | Snow | G07F 17/3244 463/26 |

OTHER PUBLICATIONS

ISA/KR, International Search Report and Written Opinion issued of PCT application No. US2016/069549, dated Apr. 17, 2017, 9 pages.

* cited by examiner

COLOR SIDE BETS IN BACCARAT

BACKGROUND

Field of Invention

The disclosure generally relates to casino card games and in particular to a method of playing the game of Baccarat with a side bet based on the suit color of the Player's and Banker hand.

Description of Related Art

Baccarat, also known as "punto banco," is played in casinos and other gambling establishments, as well as in gaming machines and online gaming. A hand of cards is dealt to the gambler and to the Banker, and gamblers bet on which hand will have a higher total point value, based on the pip values of the cards. While Baccarat is a very popular game, gamblers essentially only have one betting option for each round—whether the Player or the Banker wins—which limits the excitement of the game. The addition of a side bet to Baccarat would improve the gambler's experience as well as offer additional sources of revenue for the casino.

SUMMARY

Various methods and means for playing a game of Baccarat include a color side bet that the number of cards of a selected suit color in either the Player hand or the Banker hand will exceed the number of similarly colored cards in the opposing hand. The gambler makes a color side bet by selecting either the Player hand or the Banker hand and a suit color, red or black. If the Player hand is selected, then the Banker hand is the opposing hand; if the Banker hand is selected, then the Player hand is the opposing hand. The color side bet is that after the Baccarat hand is dealt, the selected hand will have more cards of the selected color (red or black) than the opposing hand. In one embodiment, there are four color side bets:

Player Black: the Player hand has a greater number of black cards than the Banker hand.

Player Red: the Player hand has a greater number of red cards than the Banker hand.

Banker Black: the Banker hand has a greater number of black cards than the Player hand.

Banker Red: the Banker hand has a greater number of red cards than the Player hand.

The names Player Black, Player Red, Banker Black and Banker Red are merely descriptive, and other names are expected to be used in practice. Following the standard rules for Baccarat, the cards are dealt to the Player hand and the Banker hand and the outcome is resolved to determine which hand won the Baccarat portion of the gaming round.

Once the Baccarat portion of the gaming round is dealt, the outcome of the side bet is determined. The number of red and black cards in the Player hand and in the Banker hand is determined. If the number of the cards of the selected color in the selected hand exceeds the number of cards of the selected color in the opposing hand, then the gambler wins the side bet. The gambler collects winnings from the side bet in addition to the winnings from the primary wager. If the number of the cards of the cards of the selected color in the selected hand is equal to the number of cards of the selected color in the opposing hand, then in one embodiment the gambler loses the side bet; in alternative embodiments an equal number of color cards in the Player and Banker hands is push of the color side bet, and the gambler does not lose the color side bet (e.g., wager is returned to the gambler and not collected).

For example, if the gambler bets Player Black, then the number of black cards in the Player hand is compared to the number of black cards in the Banker hand. If the number of black cards in the Player hand exceeds the number of black cards in the Banker hand then the gambler wins the side bet. If the number of black cards in the Player hand is less than the number of black cards in the Banker hand, then the side bet is lost and collected by the dealer.

If the number of black cards is the same in both hands, the color side bet may be a push or a loss depending on the embodiment. In another alternative embodiment, there are separate color side bets that the cards of a selected color will be equal in number in the Player and Banker hands (e.g., Red Tie and Black Tie).

In the above-described embodiments, the gambler may make a color side bet without making a primary wager for the Baccarat portion of the gaming round, and if the gambler does make a primary wager, it does not limit the choice of color side bets. For example, if the gambler places a side bet of Player Black, and the Banker hand wins or there is a tie, the gambler may still win the side bet where the Player hand has more black cards than the Banker hand. Alternatively, a gambler must make a primary wager to be eligible to make a color side bet. In other embodiment, if the gambler chose to bet on a particular hand for the side bet, and that hand lost the baccarat portion of the gaming round, then the gambler loses the side bet as well, regardless of whether the gambler made a primary wager. Thus, if the gambler places a side bet of Player Black, and the Banker hand wins or there is a tie, then the side bet is lost. However, if the selected hand wins during the baccarat portion of the gaming round, then the number of cards in both the Player hand and the Banker hand of the selected color is determined and compared as above.

DETAILED DESCRIPTION

In accordance with the standard manner in which Baccarat is described, the terms "Player" and "Banker" (capitalized) are designations of the two card hands dealt in each round, and the outcomes that can be wagered upon; "Player" has no particular association with any individual gambler, nor does "Banker" have any particular association with the casino or dealer.

Figure 1:
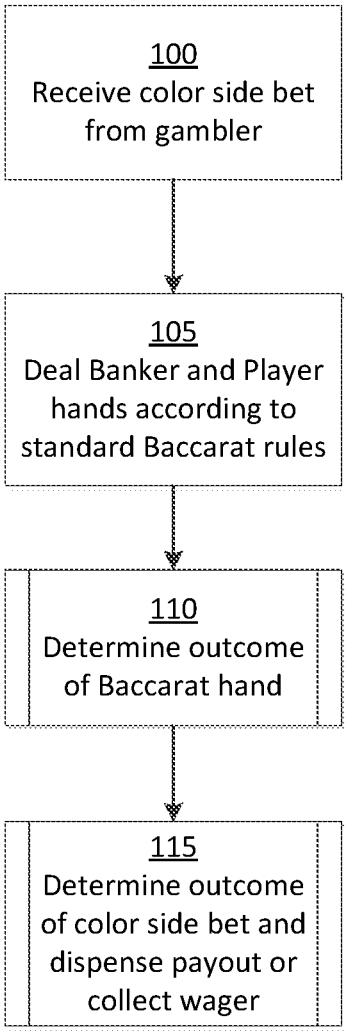
FIG. 1 is a flowchart illustrating a game of Baccarat with a color side bet according to an embodiment.

FIG. 1 is a flowchart illustrating an algorithm for a game of Baccarat with a color side bet. The operations can be performed by a human dealer in a casino gaming environment, or by a gaming machine configured in accordance with the method, or by an online gaming system communicating with a client device used by the gambler. In either a gaming machine embodiment or an online gaming system, the program code and modules implementing the functionality described herein are not native components of underlying machine or system, and thus extend the operations and functionality thereof beyond their generic functions and capabilities.

Figure 4:
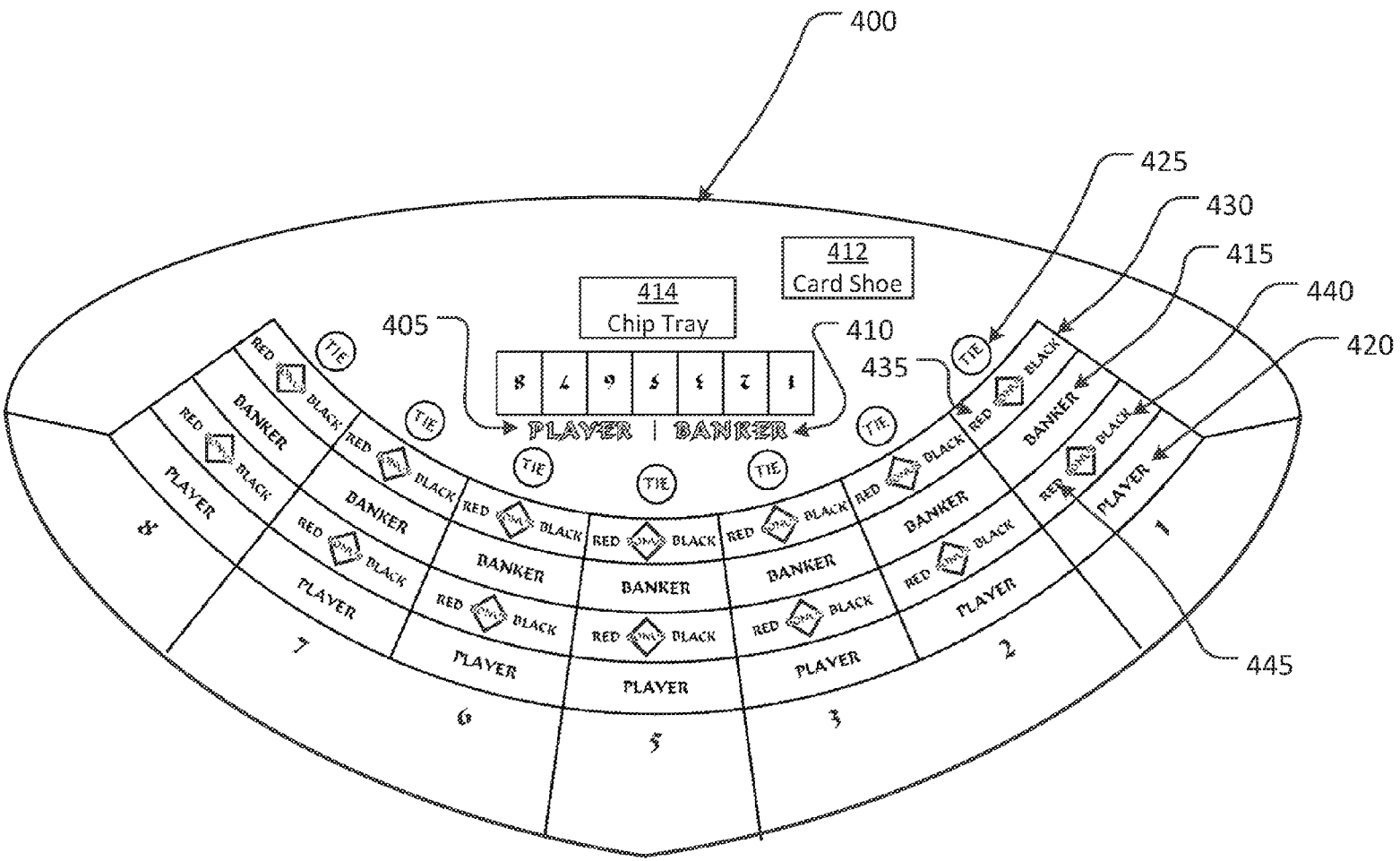
FIG. 4 illustrates a modified Baccarat gaming surface for a table game, according to one embodiment.

The game is initiated by the dealer calling for wagers, or by the gambler initiating a gaming round on gaming machine, for example by depositing funds into the gaming machine, and selecting an option to start a game, or by activating some other programmatic feature, for example in an online gaming system. In any event, the wagers are received 100 from the gambler. A gambler can place one or more wagers for the game, including a primary wager on the outcome of the Baccarat hand and/or a color side bet. The primary wager is made to participate in the primary Baccarat game. In a table gaming embodiment in a casino, a gaming surface 400 of a gaming table is provided such as illustrated in FIG. 4; a gambler designates a wager by placing chips in fixed, predetermined location on the gaming surface 400 where the primary wagers are received at corresponding primary wager spots for the Banker hand 415, Player hand 420, or Tie 425 on gaming surface 400, and the color side bets are received at side bet spots, for Banker Black 430, Banker Red 435, Player Black 440, and Player Red 445. In a gaming machine or online gaming system, the wagers are made by selecting a number of credits available to the gambler from a credit balance on the gaming machine or gaming system, and the spots would be provided on a user interface shown in a display device coupled to the gaming machine, or the gambler's client device. The gambler would use an input device (mouse, touchscreen) to graphically manipulate and designate a color side bet. Thus, the placement of a wager at a particular spot on the gaming surface acts as an information signal to the dealer (or gaming machine/system) indicating the type of wager being made.

When placing a primary wager on a spot, the gambler chooses to bet on the Player hand 420 (i.e. the Player hand will have more points after the cards are dealt), the Banker hand 415 (i.e. the Banker hand will have more points after the cards are dealt), or a tie 425 (the Player and Banker hands will have the same number of points in the end) as defined by normal Baccarat rules.

The gambler places a color side bet by selecting one of the Player hand or the Banker hand and suit color and placing a wager on the corresponding side bet spot. Using a conventional card deck there are two suit colors: hearts (red), diamonds (red), clubs (black), and spades (black). In this embodiment, there are four possible side bets for the color side bet:

Player Black: the Player hand has a greater number of black cards than the Banker hand.

Player Red: the Player hand has a greater number of red cards than the Banker hand.

Banker Black: the Banker hand has a greater number of black cards than the Player hand.

Banker Red: the Banker hand has a greater number of red cards than the Player hand.

Of course, the game can be varied to use different colors of suits (e.g., red/blue, red/white, etc.; the particular colors themselves are not significant, so long as there are two or more colors, independent of the specific suits themselves). Optionally, there are separate color side bets that the cards of a selected color will be equal in number in the Player and Banker hands (e.g., Red Tie and Black Tie).

In one group of embodiments, the gambler must make primary wager to enable or otherwise be eligible to make the color side bet. In one of these embodiments, the gambler can only place a color side bet on the same hand as for they placed a primary wager (Tie bets notwithstanding). For example if the gambler makes a primary wager on the Player hand, they can only place a color side bet on Player Black or Player Red, but not Banker Black or Banker Red; if the gambler makes a primary wager on the Banker hand, they can only place a color side bet Banker Black or Banker Red, but not on Player Black or Player Red. If the gambler places a primary wager on a Tie, then they can place a color side bet on either the Player or the Banker.

In another one of these embodiments, a primary wager is required, but the gambler may make a color side bet on either the Player or Banker hand. For example, the gambler can make a primary wager on the Player hand to win, and color side bet on the Banker hand (e.g. Banker Red or Banker Black), or vice versa. Similarly, the gambler can make a primary wager on a Tie, and a color side bet on Player Red, for example.

In another set of embodiments, the gambler may make the color side bet without making any primary wager. Thus during any gaming round the gambler may make any of the color side bets without making any wager on the Player or Bank hand.

After operation 100, when all gamblers have made respective primary and/or color side bets, the method proceeds to operation 105, wherein the Banker and Player hands are dealt according to standard Baccarat rules, including rules for drawing by the Banker and Player, until the Baccarat rules indicate the hand is completed. In a table gaming embodiment, physical cards are dealt on the gaming table from a card shuffler.

In a gaming machine or gaming system embodiment, a pseudo-random number generator (PRNG) integrated circuit is used to select a random value, which is then used to select the cards from data structure (e.g., a stored data table, array, trei, linked list, tree, or other memory structure) stored in non-transitory computer memory representing a deck (or a plurality of decks) of cards available for dealing. Given the selected card (suit and value) a graphics processor coupled to the memory generates graphical symbols representing the selected cards, which are then selectively displayed on the display device.

At operation 110, the outcome of the primary wager on the Baccarat hand is determined according to the Baccarat rules; again this can be done the dealer, gaming machine or online gaming system with corresponding program code modules implementing an algorithm that programmatically embodies the rule of Baccarat. Generally, cards with values 2-9 are worth their face value in points, face cards and 10s are worth no points, and an ace is worth 1 point. The point total for each hand is calculated and taken modulo 10, to arrive at the final value of each hand. The hand with the greater final point value is the winning hand, and the results of the primary wager are determined based on which hand is the winning hand. A tie would occur if the final point value of the Banker hand and the Player hand were the same. The outcomes are thus Player wins, Banker wins, or a there is a tie. The primary wagers are paid or collected according to the standard rules of Baccarat.

At operation 115, the outcome of each color side bet is determined, and a payout is dispensed or the color side bet is collected. The number of cards in both the Player hand and the Dealer's hand of the selected color for the color side bet is determined. Where there are color side bets from multiple gamblers covering both colors in the Player hand or the Banker hand, it is acceptable to determine the number of all of the colors of cards in the Player hand or the Banker hand, e.g., the number of red cards and the number of black cards in this operation. Payouts for the winning color side bets are made and losing color side bets are collected according to the following algorithm and logic. Specific pay table options for the color side bets are further discussed below. The payout amounts for a winning color side bet can be varied depending on the number of cards, if any, drawn by the Player or Banker hand during the Baccarat portion of the gaming round. The pay tables may be programmatically encoded using stored data tables, conditional logic, or programmatic equivalents.

In one embodiment, the color side bet is won if the selected hand (Player or Banker) contains more cards of the selected color than the opposing hand, regardless of the outcome of the primary wager. There are the following outcomes for the color side bet:

| Color Side Bet Wager | Number of Selected Color in Selected Hand v. Opposing Hand | Outcome of Color Side Bet |
|---|---|---|
| Player Black | Player Black > Banker Black | Win |
| Player Black | Player Black ≤ Banker Black | Loss |
| Player Red | Player Red > Banker Red | Win |
| Player Red | Player Red ≤ Banker Red | Loss |
| Banker Black | Banker Black > Player Black | Win |
| Banker Black | Banker Black ≤ Player Black | Loss |
| Banker Red | Banker Red > Player Red | Win |
| Banker Red | Banker Red ≤ Player Red | Loss |

In a gaming machine or online gaming system embodiment, the foregoing can be encoded in program code executed by a processor. For example, assume that code for a game has objects for a Participant class (which can be instantiated as an object ("player") of a Player class or an object ("banker") of a Banker class) and that the Participant class includes a method Count Red that returns the number of red cards in a hand and a method Count Black that returns the number of black cards. Assume further an object sideBet of class Sidebet that includes an attribute storing an enumerated variable, Type, corresponding to the type of side bet (PlayerRed, PlayerBlack, BankerRed, BankerBlack) and method Outcome that takes as input an enumerated variable indicating whether the color side bet was won or lost. The foregoing table can be represented (in pseudocode) as:

```
if (sideBet.Type=PlayerRed && player.Count_Red>banker.Count_Red) then sidebet.Outcome(Win);
if (sideBet.Type=PlayerBlack && player.Count_Black>banker.Count_Black) then sidebet.Outcome(Win);
if (sideBet.Type=BankerRed && banker.Count_Red>player.Count_Red) then sidebet.Outcome(Win);
if (sideBet.Type=BankerBlack && banker.Count_Black>player.Count_Black) then sidebet.Outcome(Win);
else sidebet.Outcome(Loss).
```

The foregoing is one example of an algorithm with one type of control logic that can be used to implement a determination of the outcome of a color side bet; other equivalent algorithms may use another type of control logic, such as table driven logic, select/case logic, register logic, or the like, depending on the particular implementation language Where the gambler is limited to making a color side bet on the same hand on which the gambler placed the primary wager, then in one embodiment, the gambler must win the primary wager in order to win the color side bet. For example, if the gambler bets on the Player hand to win, the gambler can bet either Player Black or Player Red, but not either Banker Black or Banker Red. Accordingly, in this embodiment the gambler can win the primary wager and the color side bet, win the primary wager but lose the side bet, or lose both the primary wager and the color side bet, but not lose the primary wager and win the color side bet. In this embodiment, there are the following outcomes:

| Primary Wager | Selected Color for Side Bet | Number of Selected Color in Winning Hand v Opposing Hand | Outcome of Color Side Bet |
|---|---|---|---|
| Player Wins | Red | Player Red > Banker Red | Win |
| Player Wins | Red | Player Red ≤ Banker Red | Loss |
| Player Wins | Black | Player Black > Banker Black | Win |
| Player Wins | Black | Player Black ≤ Banker Black | Loss |
| Banker Wins | Red | Banker Red > Player Red | Win |
| Banker Wins | Red | Banker Red ≤ Player Red | Loss |
| Banker Wins | Black | Banker Black > Player Black | Win |
| Banker Wins | Black | Banker Black ≤ Player Black | Loss |
| Natural Tie | All | Any | Push |
| Non-natural Tie | All | Any | Loss |

As shown in this embodiment, each hand having the same number of cards of the selected color (e.g., equal number of red cards in the Player's and Dealer's hand) is considered a loss of the side bet, and the color side bet wager is collected. The above set of outcomes can be programmatically encoded using conditional logic (e.g. IF-THEN statements), table-driven logic or state machines, or other equivalent implementations.

Figure 2:
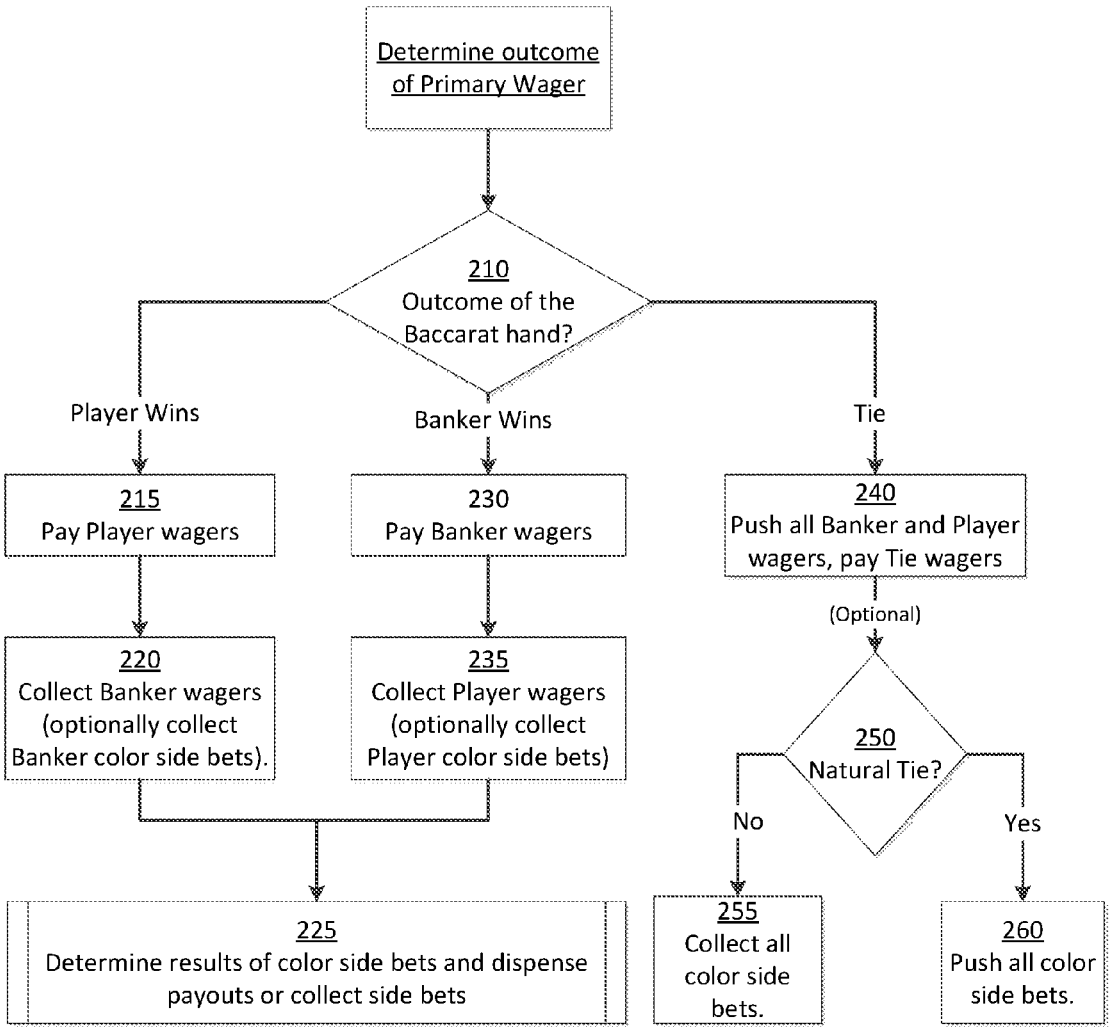
FIG. 2 is a flowchart for determining the outcome of the primary wager of a game of Baccarat with a color side bet in one embodiment.
Figure 3:
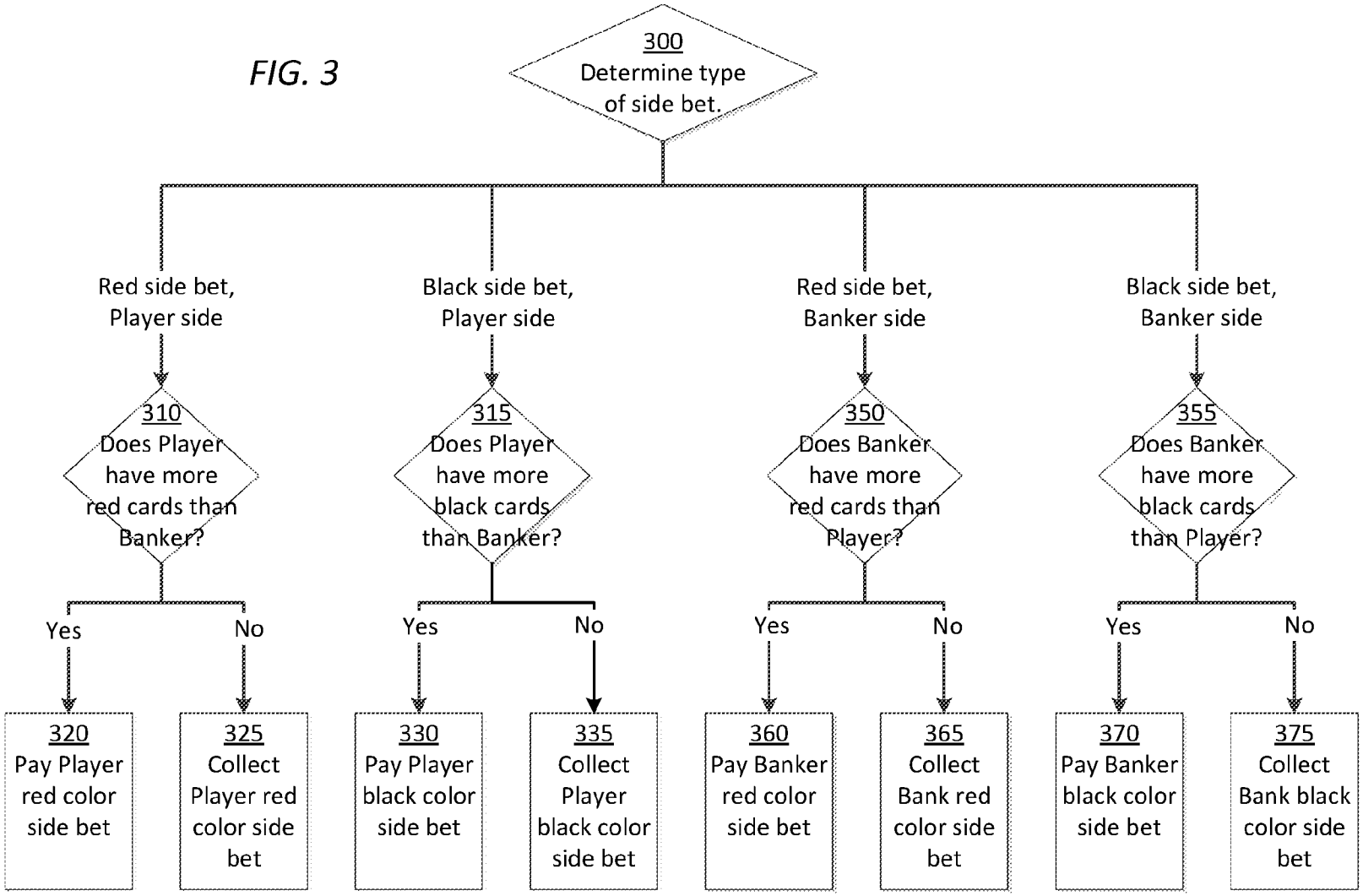
FIG. 3 is a flowchart for determining the outcome of the color side bets on Player's and Banker hands in one embodiment.

FIGS. 2 and 3 are flowcharts illustrating algorithms for implementing the operations 110 and 115 of determining the outcome of the primary wager and color side bet in the embodiments where the gambler must win the primary wager on the Baccarat hand in order to win the color side bet. The algorithms represented by the flowcharts may be implemented in program code using procedural logic, state machines, or the like.

At operation 210, the outcome of the primary wager is determined. The point values of the Player hand and the Banker hand are calculated according to standard Baccarat rules. There are three outcomes that may arise: the Player hand wins (i.e. the Player hand has more points than the Banker hand), the Banker hand wins (i.e. the Banker hand has more points than the Player hand), or a tie (i.e. the Player hand and the Banker hand have the same number of points).

If the Player hand wins, payouts on the primary wagers placed on the Player hand are dispensed at operation 215. Any primary wagers placed on the Banker hand are collected by the dealer at operation 220. In the embodiment where the gambler must win the primary wager in order to win color side bet, any color side bets on the Banker hand may be collected at this point as well (or alternatively collected subsequently during the collection steps 325, 335, 365, and 375 shown in FIG. 3). If a color side bet was placed on the Player hand, the results of the Player color side bets are determined at operation 225, which is further discussed below.

If the Banker hand wins, payouts on the primary wagers placed on the Banker hand are dispensed at operation 230. Any primary wagers placed on the Player hand are collected.

In the embodiment where the gambler must win the primary wager in order to win color side bet, any color side bets on the Player hand may be collected at this point as well (or alternatively collected subsequently during the collection steps 325, 335, 365, and 375 shown in FIG. 3). If a color side bet was placed on the Banker hand, the results of any Banker color side bets are determined at operation 225.

If there is a tie, all primary wagers placed on the Banker hand or the Player hand are pushed at operation 240 (e.g. the primary wagers are returned to the gambler or gamblers who placed them, or otherwise indicated as being pushed). All primary wagers placed on a tie are paid out, as well, at operation 240. In one embodiment, it is determined 250 whether the tie was a "Natural Tie" (i.e. no other cards were dealt to either hand, according to standard Baccarat rules). In this embodiment, if the tie was "Natural", then all color side bets are pushed at operation 260, and if the tie was not "Natural", then the dealer collects 255 all color side bets. In an alternate embodiment, a gambler could still win the side bet if there was a tie and the selected hand contained more cards of the selected color.

FIG. 3 is flowchart illustrating an algorithm for determining the outcome of the color side bets on Player's and Banker hands and dispensing payouts on winning side bets and collecting losing ones (operation 225). In these embodiments, red and black are used as colors for the cards, though any two or more colors could be used. In a gaming machine or online gaming environment, the algorithm of FIG. 3 (and logical equivalents thereof) are example means for performing the function of determining an outcome of a color side bet.

Referring to FIG. 3, the results of the color side bet depend on what kind of side bet, if any, the gambler placed on the Player hand, e.g., either a Player Red or a Player Black color side bet. At operation 300 the type of color side bet is determined. If a gambler placed a Player Red side bet, then the number of red cards in the Player hand is compared 310 to the number of red cards in the Banker hand. If the Player hand contains more red cards than the Banker hand, then the gambler wins the side bet, and the corresponding payout is dispensed 320 to the gambler. In the embodiment presented in FIG. 3 if the Player hand contains as many or fewer red cards than the Banker hand, then the gambler loses the side bet and their side bet is collected 325. In an alternate embodiment, the Player hand and the Banker hand having the same number of red cards would result in a push for the side bet. In another embodiment, the Player hand and the Banker hand having the same number of red cards would result in the gambler winning the side bet.

If a gambler placed a Player Black side bet, the process is similar. The number of black cards in the Player's and Banker hands are compared 315, and the results of the side bet depend on the results of that comparison at operations 330 and 335. If the Player hand contains more black cards than the Banker hand, then the gambler wins the side bet, and the corresponding payout is dispensed 330 to the gambler. In the embodiment presented in FIG. 3, if the Player hand contains as many or fewer black cards than the Banker hand, then the gambler loses the side bet, and their side bet is collected 335. In an alternate embodiment, the Player hand and the Banker hand having the same number of black cards would result in a push for the side bet. In another embodiment, the Player hand and the Banker hand having the same number of black cards would result in the gambler winning the side bet.

The steps for handling a Banker side bet are similar. If a gambler placed a Banker Red side, then the numbers of red cards in the Banker hand and the Player hand are compared 350. The gambler is paid depending on the results of that comparison at operations 360 and 365. If the gambler placed a Banker Black side bet, then the numbers of black cards in the Banker hand and the Player hand are compared 355. A payout is dispensed 370 or the color side bet collected 375 depending on the results of that comparison at operation 355.

The dealer (or gaming machine or system) dispenses a payout to the gambler when the gambler wins the color side bet 320, 330, 360, 370. In one embodiment, the gambler is paid based on the amount the gambler wagered. In other embodiments, the gambler is paid a fixed amount for winning the side bet. In some embodiments, the payout amount depends on whether the Banker hand or the Player hand drew a card during the Baccarat portion of the gaming round. In certain embodiments, the payout depends on whether the side bet was placed on the Banker's or the Player hand. The specific payout ratios are determined by the pay table in use for the game. The manner in which payouts are dispensed can include dispensing chips from a coin tray to a location on a gaming surface associated with the color side bet, adding credits to a credit meter of a gaming machine or gaming system, or equivalents.

As described above, in one of the embodiments, the gambler must win the primary wager in order to win a color side bet. Tables 1-4 are example pay tables comprising different payout scenarios for this embodiment, assuming the gambler has placed a primary wager on the Banker hand. In these paytables there are additional variations in payouts depending on whether or not the Player hand or the Banker hand drew a card during the Baccarat round. A "−1x" indicates a loss of the indicated wager (whether primary or side bet).

TABLE 1

| Scenario | Color Side bet Payout |
|---|---|
| Banker hand wins primary wager and has cards more of chosen color: | |
| No additional cards drawn | 3x |
| Player hand drew a card | 18x |
| Banker hand drew a card | 5x |
| Both Banker hand and Player hand drew a card | 3x |
| Natural tie in primary wager | 0x |
| Player hand wins the primary wager | −1x |
| Player hand has same number or more cards of chosen color | −1x |
| Non-Natural tie in primary wager | −1x |

TABLE 2

| Scenario | Color Side bet Payout |
|---|---|
| Banker hand wins primary wager and has cards more of chosen color: | |
| No additional cards drawn | 3x |
| Player hand drew a card | 10x |
| Banker hand drew a card | 5x |
| Both Banker hand and Player hand drew a card | 3x |
| Tie (Natural or non-Natural) in primary wager | 0x |
| Player hand wins the primary wager | −1x |
| Player hand has same number or more cards of chosen color | −1x |

TABLE 3

| Scenario | Color Side bet Payout |
|---|---|
| Banker hand wins primary wager and has cards more of chosen color: | |
| No additional cards drawn | 2x |
| Player hand drew a card | 12x |
| Banker hand drew a card | 5x |
| Both Banker hand and Player hand drew a card | 2x |
| Natural tie in primary wager | 0x |
| Banker hand and Player hand have same number of cards of chosen color | 0x |
| Player hand wins the primary wager | −1x |
| Player hand has more cards of chosen color | −1x |
| Non-Natural tie in primary wager | −1x |

TABLE 4

| Scenario | Color Side bet Payout |
|---|---|
| Banker hand wins primary wager and has cards more of chosen color: | |
| No additional cards drawn | 2x |
| Player hand drew a card | 9x |
| Banker hand drew a card | 4x |
| Both Banker hand and Player hand drew a card | 2x |
| Tie (Natural or non-Natural) in primary wager | 0x |
| Banker hand and Player hand have same number of cards of chosen color | 0x |
| Player hand wins the primary wager | −1x |
| Player hand has more cards of chosen color | −1x |

As mentioned above with respect to FIGS. 3*a* and 3*b*, where the Player hand and Banker hand have the same number of the selected color card, the outcome of the color side bet is a loss to the gambler (as illustrated in operations 325, 335, 365, and 375), or may be a push. Tables 1 and 2 illustrate the former alternative (payout is −1×), while Tables 3 and 4 illustrate the latter alternative (payout is 0×).

Tables 5-8 are example pay tables comprising different scenarios during a game of Baccarat with color side bets where a gambler placed a side bet on the Player hand. Again, alternatives are shown for ties in the number of cards of the selected color.

TABLE 5

| Scenario | Payout |
|---|---|
| Player hand wins primary wager and has cards more of chosen color: | |
| No additional cards drawn | 3x |
| Player hand drew a card | 5x |
| Banker hand drew a card | 20x |
| Both Banker hand and Player hand drew a card | 3x |
| Natural tie in primary wager | 0x |
| Banker hand wins the primary wager | −1x |
| Banker hand has same number or more cards of chosen color | −1x |

TABLE 6

| Scenario | Payout |
|---|---|
| Player hand wins primary wager and has cards more of chosen color: | |
| No additional cards drawn | 3x |
| Player hand drew a card | 5x |

TABLE 6-continued

| Scenario | Payout |
|---|---|
| Banker hand drew a card | 12x |
| Both Banker hand and Player hand drew a card | 3x |
| Tie (Natural or non-Natural) in primary wager | 0x |
| Banker hand wins the primary wager | −1x |
| Banker hand has same number or more cards of chosen color | −1x |

TABLE 7

| Scenario | Payout |
|---|---|
| Player hand wins primary wager and has cards more of chosen color: | |
| No additional cards drawn | 2x |
| Player hand drew a card | 5x |
| Banker hand drew a card | 14x |
| Both Banker hand and Player hand drew a card | 2x |
| Natural tie in primary wager | 0x |
| Player hand and Banker hand have same number of cards of chosen color | 0x |
| Banker hand wins the primary wager | −1x |
| Banker hand has more cards of chosen color | −1x |

TABLE 8

| Scenario | Payout |
|---|---|
| Player hand wins primary wager and has cards more of chosen color: | |
| No additional cards drawn | 2x |
| Player hand drew a card | 4x |
| Banker hand drew a card | 11x |
| Both Banker hand and Player hand drew a card | 2x |
| Tie (Natural or non-Natural) in primary wager | 0x |
| Player hand and Banker hand have same number of cards of chosen color | 0x |
| Banker hand wins the primary wager | −1x |
| Banker hand has more cards of chosen color | −1x |

The particular selection of a specific paytable provides for different distributions of outcomes and returns to the gambler and the gaming establishment. Selection of a pay table may be made to maximize the return to the gaming establishment for example.

FIG. 4 illustrates a modified Baccarat gaming surface 400 for a table game embodiment, according to one embodiment. The dealer deals cards to the Player hand area 405 and the Banker hand area 410. The Player hand area and the Banker hand area may be designated explicitly by the table surface, or may be an unmarked area. The deck of cards from which the Player hand and Banker hand are dealt from card shoe 412. In the embodiment presented by FIG. 4, the gaming chips are held in chip tray 414, though they may be held in a separate area. The gaming chips are associated with real monetary values in a recognized currency, such as US dollars.

The surface 400 has a plurality of distributed, visually demarcated betting areas 416 distributed across the surface. Each betting area includes a primary wager spots 415, 420, 425, and color side bet spots 435, 430, 445, or 440. Color side bet spots 430, 435 for Banker side bets are disposed adjacent Banker primary wager spot 415. Color side bet spots 440, 445 for Player side bets are disposed adjacent Player primary wager spot 420. In the embodiment illustrated in FIG. 4, in each betting area the spots are arranged from closest to the dealer to closest to the gambler in the following order: Tie spot 425; color side bet spots 430, 435 for Banker side bets; Banker primary wager spot 415; color side bet spots 440, 445 for Player side bets; Player primary wager spot 420. In alternative embodiment, in each betting area the spots are arranged from closest to the dealer to closest to the gambler in the following order: Tie spot 425; Banker primary wager spot 415; color side bet spots 430, 435 for Banker side bets; Player primary wager spot 420; color side bet spots 440, 445 for Player side bets. Other orderings are also possible.

The receipt or placement of a gaming chips or physical objects indicating real money monetary values at spots 415, 420, or 425, specifies a primary wager on the Banker hand, the Player hand, or a tie respectively. The receipt or placement of gaming chips at spots 435, 430, 445, or 440, specifies color side bet on Banker Red, Banker Black, Player Red, or Player Black respectively. The number and types of chips placed by the gambler designate the size of the primary wager or color side bet. In some embodiments, the player uses a card for electronic wager transactions, passing the card through or by a card reader, rather than placing chips. In gaming machine embodiments the primary wager areas (415, 420, 425) and the color side bet areas (430, 435, 440, 445) area represented graphically on a display device of gaming machine, and the wagers are placed by the user providing an input (e.g., key or button selection, touch screen input) selecting various graphical representations, where the wagers are decremented as credits from the credit balance stored by a credit meter.

When a gambler wins a color side bet, the payout is provided by the dealer dispensing chips from the coin tray 414 to (or proximate to) the corresponding color side bet spot 435, 430, 445, or 440 at which the gambler placed the wager. When a gambler loses a color side bet, the dealer collects the wagered chips from the color side bet spot back to the coin tray 414.

A pay table (not shown), including payouts for primary wagers and color side bets may be displayed on the table surface itself, or on a signpost attached to the table and visible to all gamblers. The table layout in FIG. 4 only shows playing areas for eight baccarat gamblers, but other embodiments of the table layout can accommodate any number of gamblers. Other table layouts may have alternative arrangements of features, or have additional or alternative features. The table may be embodied as a physical object (e.g., a table felt) or be embodied virtually in a gaming application on a computing device. Payouts of winning wagers are made by disposition of chips from the coin tray to the location of the color side bets on the respective color side bet spots.

Figure 5:
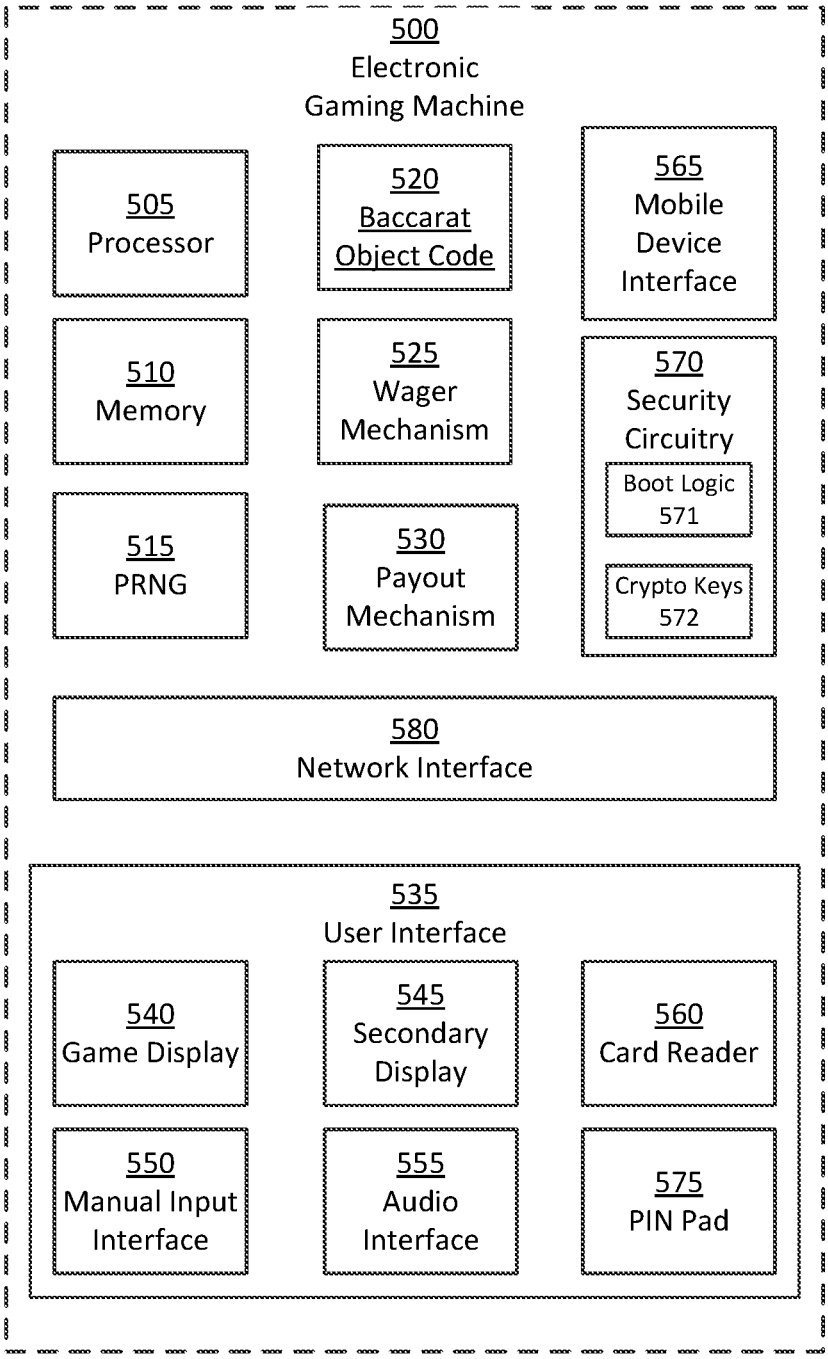
FIG. 5 illustrates a block diagram of an electronic gaming machine configured to execute a game of the disclosed baccarat variant, according to one embodiment.
Figure 6:
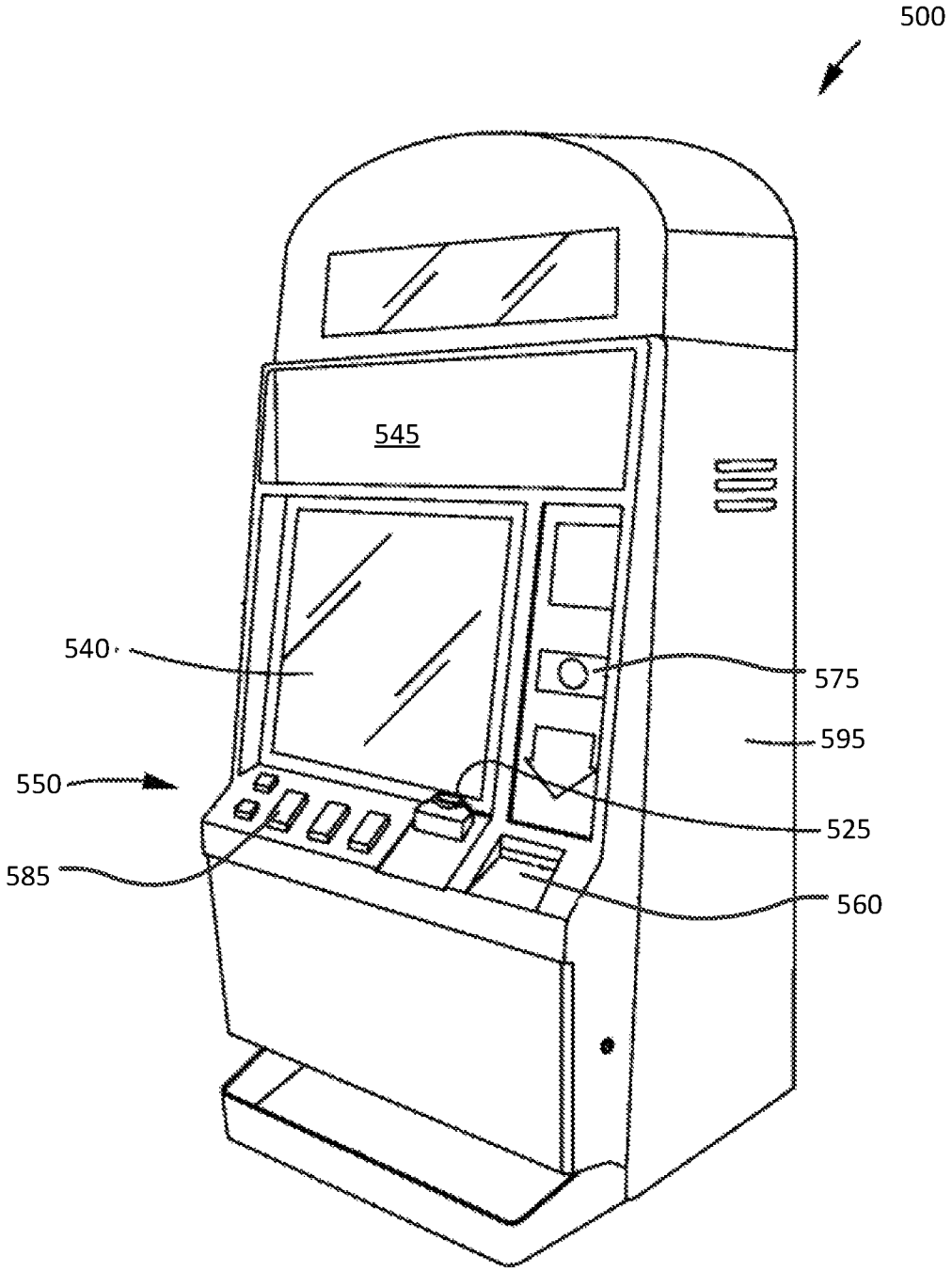
FIG. 6 illustrates an example of an external view of an electronic gaming machine configured to execute a game of the disclosed baccarat variant, according to one embodiment.

FIG. 5 illustrates a block diagram of an electronic gaming machine 500 configured to host a game of the disclosed baccarat variant, according to one embodiment. FIG. 6 illustrates an external view of one example of a gaming machine 500. One or more users may play the disclosed baccarat game on the electronic gaming machine 500, which accepts a primary and a color side bet from the user, hosts a baccarat game on the machine 500 for the user, and dispenses a payout to the user based on the outcome of the game. The electronic gaming machine 500 may be implemented as a standalone device or may be integrated into a casino management system. As described, the components of the electronic gaming machine 500 may be implemented as hardware components, software modules, or a combination of the two.

The processor 505, which may comprise one or more individual processors, receives and processes instructions for the baccarat game, according to the operations, algorithms, and data objects described above. Furthermore, the processor 505 outputs and receives signals to and from payment acceptor 525, cashout device 530, input/output devices 535, mobile devices interface 565, security circuitry 570, and network interface 580, and credit meter 590. The processor 505 may be embodied as a microprocessor or an application-specific integrated circuit (ASIC). In a standalone device, the gaming machine 500 is included in housing that encloses and supports the processor 505, payment acceptor 525, the cashout device 530, input/output devices 535 (including display 540 and optional secondary display 545), the mobile devices interface 565, the security circuitry 570, the network interface 580 and the credit meter 590.

The program memory 510 is communicatively coupled to the processor 505, and loads object code program instructions 520 during bootup and during operation. The object code 520 in combination with the processor 505 and memory 510, provides various means for performing the function and algorithms described herein. Instructions from object code 520 as stored in the program memory 510 are received and executed by the processor 505, operating in accordance with the methods disclosed in the flowcharts in FIGS. 1, 2, and 3, and making payouts according to any of the paytables set forth above, or other paytables as may be stored in memory 510 or otherwise controlled by object code 520. The program memory 510 is a non-transitory storage device, that may include a combination of volatile memory (e.g., RAM) and non-volatile memory (e.g., a hard disk, flash memory, or removable storage medium). As configured with the instructions in program memory 510, the gaming machine 500 includes functionality and features that are not part of the generic functions of a processor 505, and thus provides for a specific functional and operational extension thereof, offering improved overall performance and capabilities. For example, during operation under control of the object code 520 the memory 510 stores a representation of each of a plurality of playing cards, each playing cards having a color from the plurality of card colors, the processor deals a Player hand and Banker hand by randomly selecting representations of the playing cards from the memory using a pseudorandom number generator, and stores these hands in the memory 510, and the processor determines using program logic an outcome of the color side bet based on the number of cards of a selected color in each of the Player and Banker hands, none of which of are native functions of the processor 505. For purposes of convenience the processor 505 and memory 510 may be jointly referred here as an execution unit.

The memory 510 may comprise power-hit tolerant memory, which can be used as a persistent memory for critical data. One characteristic of a power-hit tolerant memory is a fast data transfer time. Thus, in the event of a power failure, which might be indicated by a sudden power fluctuation, the critical data can be quickly loaded from volatile memory, such as RAM associated with the processor 505, into the power-hit tolerant memory of memory 510 and saved.

In one embodiment, the gaming device 500 can be configured to detect power fluctuations and in response, trigger a transfer of critical data from RAM to the power-hit tolerant memory of memory 510. One example of a power-hit tolerant memory is a battery-backed RAM. The battery supplies power to the normally volatile RAM so that in the event of a power failure data is not lost. Thus, a battery-backed RAM is also often referred to as a non-volatile RAM or NV-RAM. An advantage of a battery-backed RAM is that the fast data transfer times associated with a volatile RAM can be obtained. The NV-RAM may be configured to store firmware this are executed as part of a secure bootup operation, as further described below.

The pseudo-random number generator (PRNG) 515 can be used to generate random numbers that can be used to determine outcomes for the baccarat game on the electronic gaming device 500. The PRNG may be an Intel Corp. Digital Random Number Generator (DRNG) in its Ivy Bridge chip architecture, a Freescale Semiconductor Kinetis M Series KM1×MCU or C29x Crypto Coprocessor, such as FDK Corporation's TRNG RPG100, or any hardware equivalents. Typically, as described above, the outcomes generated on a gaming device, such as 500, are considered critical data. Thus, generated outcomes may be stored to memory 510 and may be loaded into power-hit memory in memory 510 in the event of power loss.

While each electronic gaming machine 500 may include both an internal processor 505 and an internal program memory 510, the functions of the processor 505 or the program memory 510 may be executed external to the electronic gaming machine 500. For example, in one embodiment, a gaming server may perform some of the operations set forth in FIGS. 1, 2, and 3, and send the results (e.g., winning and losing hands, payout information) to the electronic gaming machine 500 over a network for handling. The electronic gaming machine 500 is configured to execute the baccarat object code 520 that controls the operation of the gaming machine 500 in conformance with the algorithms described herein.

The payment acceptor 525 is configured to receive payments for primary wagers and color side bets in the form of items of monetary value. The payment acceptor 525 detects when a primary wager and/or a color side bet have been received from a user of the electronic gaming machine 500. The payment acceptor is configured to accept the wagers of the physical items such as tickets or bills, coins or casino tokens, and may further include a digital interface configured to accept the wagers as digital items such as electronic money, values stored in non-transitory stored value card, or electronic money transfer based data stored in an account management system. The digital interface may be configured to accept virtual currencies from a user, such as credits used in a social network, social gaming system, or virtual world. In one case, the payment acceptor 525 communicates with the card reader 560 to accept monetary inputs from a stored-value card, a credit card, or a betting card. The payment acceptor 525 is further configured in one embodiment to interface with account management systems holding accounts for users, so as to debit a user's account for wagers (and/or transfer credits to the gaming machine for use in wagers) and credit the user's account with payouts (and/or transfer credits from the gamine machine back to the user's account). The payment acceptor 525 may be configured to receive a personal identification number (PIN) input by the gambler through PIN pad 575 to verify the identity of the gambler. In one embodiment, the payment acceptor uses mobile device interface 565 to verify the identity of the gambler. The payment acceptor can further include a payment validator to validate the authenticity or identity of the physical items received by the payment acceptor, such as a bill validator, coin validator, or financial card validator. The payment acceptor 525 may be any combination of the aforementioned devices. Furthermore, the payment acceptor 525 may store the wagers. For example, a payment acceptor that accepts hard currency may include a locked receptacle for bills or coins.

The credit meter 590 is configured to show a credit balance of the number of credits that the player has accrued on the gaming machine 500, as either received via the payment acceptor 525 and from the outcomes of winning wagers. When the primary and color side bets are received from the user, the payment acceptor 525 sends a signal to the processor 505 indicating that the wagers have been received and the amount of each wager, whereupon the processor 505 decrements the amounts from the credit balance held by credit meter 590. Whenever the player wins a primary wager or color side bet and receives a payout thereon, the amount of payout is incremented to the credit balance held by the credit meter 590, based upon the payout amounts indicated in the payout tables stored in the memory 510.

The cashout device 530 dispenses a payout to the user based on credits held by the credit meter 590. The cashout device 530 receives a signal from the processor 505 to dispense a payout, determined by the processor 505, to the user, based on the amount held by the credit meter 590. The cashout device 530 may dispense the payout as bills, casino tokens, coins, an electronic transfer, a stored-value card, or transfer credits to a user's account held by an operator, bank, or other institution. In one embodiment, the cashout device 530 uses the card reader 560 or the mobile device interface 565 to deliver a payout to the gambler to a stored value card.

The input/output devices 535 allows the user to input commands to the electronic gaming machine 500. The input/output devices 535 may comprise a game display 540, a secondary display 545, an audio interface 555, a card reader 560, a PIN pad 575 and a manual input interface 550 such as buttons 585.

The game display 540 outputs game information to the user. The display 540 receives signals from the processor 505 and displays information based on the received signals. The game display 540 conveys to the user the Player hand, the Banker hand, wager amounts for the primary wager and color side bets, game outcomes, and any other relevant information. Furthermore, the game display 540 may convey to the user information not directly related to the game, such as player profile information, customer service information, or other relevant information. The game display 540 may be in the form of lights, screens, analog displays, or a combination of displays. Furthermore, some aspects of the display 540 may be combined with aspects of the input/output devices 535. In one example electronic gaming machine 500, the game display 540 and manual input interface 585 are embodied as a single touchscreen.

The game display 540 displays a graphical user interface representing the baccarat variant described herein, for example with an interface corresponding in part to the gaming surface 400 illustrated in FIG. 4. In this embodiment, the user interface includes graphical representations of the primary wager areas and color side bet spots for one or more players, along with graphical representations of the card shuffler and coin tray. In one embodiment, graphical representations are interactive, and thus the user may touch the display 540 or click upon the respective graphical representations to place the primary wager and color side bets.

The optional secondary display 545 outputs additional information to the gambler. The secondary display 545 receives signals from the processor 505 and displays information based on the received signals. The secondary display 545 provides information to the gambler that might interest the gambler, but is not directly related to the baccarat game. For example, in one embodiment, the secondary display 545 may provide advertisements to the gambler. In one embodiment, the secondary display 545 may provide to the user a video feed from a TV station or other video source. The video displayed on the secondary display 545 may be selected by the user through the manual input interface 550.

The manual input interface 550 may be one or more buttons, switches, levers, keyboards, joysticks, touchscreens, number pads, card readers, or any other apparent interface device. Furthermore, the manual input interface 550 may be a combination of the aforementioned interface devices. Each element of the manual input interface 550 may have a different function. In one example embodiment, an electronic gaming machine 500 has a button to start a round of baccarat and one or more buttons to increase and/or decrease primary wager; each color side bet may be linked to a corresponding input button on the housing 595 of the gaming machine; the user presses the input button to make the corresponding color side bet. The interface 550 may further include a device such as a button to cause the cashout device to dispense the credits held by the credit meter 590. In another embodiment, the roles of the manual input interface 550 and the game display 540 are performed by a touchscreen. Based on user interaction with the manual input interface 550, the manual input interface 550 sends signals to the processor 505.

The audio interface 555 provides audio to the user. The audio interface receives signals from the processor 505 and projects audio based on the received signals. The audio projected through the audio interface 555 may be dependent on the user's performance in the baccarat game. In one embodiment, the audio interface projects audio that is dependent on what is shown on the game display 540 and/or the secondary display 545.

In other embodiments, a mobile device interface 565 can be provided for communicating with a mobile device, such as a cell phone or a tablet computer carried by players or casino personnel temporarily in the vicinity of the electronic gaming device 500. A wireless communication protocol, such as Bluetooth™ and a Wi-Fi compatible standard, can be used for communicating with the mobile devices via the mobile device interface 565. In one embodiment, the mobile device interface 565 can implement a short range communication protocol, such as a near field communication (NFC) protocol used for mobile wallet applications. NFC is typically used for communication distances of 4 cm or less. In addition, a wired communication interface, such as a docking station, can be integrated into the electronic gaming device 500. The wired communication interface can be configured to provide communications between the electronic gaming device 500 and the mobile device and/or providing power to the mobile device.

The electronic gaming device 500 can include security circuitry 570. The security circuitry 570 provides a hardware root of trust to ensure the integrity of the gaming machines operations and protect against tampering or other malicious events. The security security 570 can include a secure boot logic 571 and cryptographic keys 572 used by the PRNG 515. Alternatively, the more cryptographic keys 572 may be stored in NV-RAM. Upon bootup, the processor 505 reads the boot logic 571 which identifies definitions on the type of cryptographic operations that are to be performed during the boot up and the location of the cryptographic keys 572 that are used during by the PRNG 515 and other functions. In particular, the boot logic 571 can identify the type of cryptographic operations and location of cryptographic keys 572 used to authenticate the system firmware, such as a boot loader, and the operating system or a hypervisor. Each of the firmware, the boot loader, and the operating system or hypervisor can be protected by confidentiality and integrity operations (e.g., encryption, Hash-based Message Authentication Code (HMAC), digitally signed and or hash operation) or integrity operations only (digitally signed). For example, the boot logic 571 can include an indicator that the firmware is protected by a digital signature with a cryptographic key 572 that is stored in the NV-RAM. In some example embodiments, a same cryptographic key or different cryptographic keys can be used for the different cryptographic operations during the bootup. In particular, each stage of the boot up can use same or different cryptographic operation and can have its own cryptographic key or can use the same cryptographic key. Various implementations of a secure boot mechanism are disclosed in U.S. Pat. Nos. 8,775,784, 7,827,397, 9,070,251, all of which are incorporated by reference herein in their entirety.

The security circuitry 570 may further include security sensors and circuitry for monitoring the sensors. The security circuitry 570 can be configured to operate while the gaming device is receiving direct power and operational to provide game play as well as when the gaming device is uncoupled from direct power, such as during shipping or in the event of a power failure. The electronic gaming device 500 can be equipped with one or more secure enclosures, which can include locks for limiting access to the enclosures. One or more sensors can be located within the secure enclosures or coupled to the locks. The sensors can be configured to generate signals that can be used to determine whether secure enclosures have been accessed, locks have been activated, or the electronic gaming device 500 has been moved to an unauthorized area. The security monitoring circuitry can be configured to generate, store and/or transmit error events when the security events, such as accessing the interior of the gaming device, have occurred. The error events may cause the electronic gaming device 500 to place itself in a "safe" mode where no game play is allowed until the error event is cleared.

The network interface 580 connects the electronic gaming machine to external devices, such as a casino management system. The network interface 580 may facilitate sending signals from the electronic gaming machine 500 to other devices. Furthermore, the network interface 580 may facilitate the electronic gaming machine 500 with receiving signals. For example, the processor 505 may send information on the outcome of the baccarat game, information identifying the user, or any other relevant information to external servers through the network interface 580.

The invention claimed is:

1. A method for playing a baccarat card game using a modified baccarat table surface, the surface comprising:

a coin tray storing chips having a real money monetary value;

a Player hand area for receiving cards from a card shoe for a Player hand;

a Banker hand area for receiving cards from the card shoe for a Banker hand;

a plurality of betting areas, distributed across the surface, each betting area comprising:

a Player primary wager spot for receiving a wager of at least one chip on the Player hand to win the baccarat game;

a Banker primary wager spot for receiving a wager of at least one chip on the Banker hand to win the baccarat game;

a Tie primary wager spot for receiving a wager of at least one chip on a tie between the Banker hand and the Player hand;

a first color side bet spot, for receiving a color side bet of at least one chip that the Player hand will have more red cards than the Banker hand after the baccarat game;

a second color side bet spot for receiving a color side bet of at least one chip that the Player hand will have more black cards than the Banker hand after the baccarat game;

a third color side bet spot for receiving a color side bet of at least one chip that the Banker hand will have more red cards than the Player hand after the baccarat game; and a fourth color side bet spot for receiving a color side bet of at least one chip that the Banker hand will have more black cards than the Player hand after the baccarat game;

a paytable indicating a payout for each of the color side bets;

wherein the method comprises:

receiving as a selection of a color side bet, a wager of at least one chip having a real money monetary value from a gambler on at least one of the color side bet spots;

dealing the Player hand in the Player hand area and the Banker hand in the Banker hand area according to standard Baccarat rules, the Player hand and the Banker hand comprising cards, each card having a color from a plurality of card colors;

responsive to a number of cards of the selected color in the selected hand exceeding a number of cards of the selected color in an opposing hand, dispensing a payout of chips, according to a payout indicated for a winning color side bet in the paytable, from the coin tray to the color side bet spot where the wager was received; and responsive to the number of cards of the selected color in the selected hand being less than the number of cards of the selected color in the opposing hand collecting the color side bet from the selected color side bet spot into the coin tray;

determining whether a winning hand in the baccarat card game is the Player hand or the Banker hand;

determining whether the winning hand is the same as the selected hand; and responsive to the winning hand not being the same as the selected hand, collecting the color side bet from the color side bet spot to the coin tray.

2. The method of claim 1, further comprising:

responsive to the number of cards of the selected color in the selected hand equaling the number of cards of the selected color in the opposing hand, returning the color side bet to the gambler.

3. The method of claim 1, further comprising:

responsive to the number of cards of the selected color in the selected hand equaling the number of cards of the selected color in the opposing hand, dispensing a payout of chips, according to a payout indicated for a winning color side bet in the paytable, from the coin tray to the color side bet spot where the wager was received.

4. The method of claim 1, further comprising:

responsive to an outcome of the baccarat game being a tie, returning the color side bet to the gambler.

5. The method of claim 1, wherein receiving as a selection of a color side bet further comprises:

determining whether a primary wager of at least one chip on an outcome of the baccarat game was received in the Player primary wager spot, the Banker primary wager spot, or the Tie primary wager spot;

responsive to determining that the primary wager has been received on the Banker primary wager spot, enabling a color side bet only on the Banker hand;

responsive to determining that the primary wager has been received on the Player primary wager spot, enabling a color side bet only on the Player hand; and responsive to determining that the primary wager has been received on the Tie primary wager spot, enabling a color side bet on either the Player hand or the Banker hand.

6. The method of claim 1, wherein a payout indicated by the paytable for at least one of the color side bets is dependent on a number of cards dealt during the baccarat game.

7. The method of claim 1, wherein dispensing a payout of chips, according to a payout indicated for a winning color side bet in the paytable, further comprises:

if the selected hand is the Player hand and the selected color is red, then responsive to the number of red cards in the Player hand exceeding the number of red cards in the Banker hand, dispensing a payout associated with a winning side bet from the coin tray to the first color side bet spot;

if the selected hand is the Player hand and the selected color is black, then responsive to the number of black cards in the Player hand exceeding the number of black cards in the Banker hand, dispensing a payout associated with a winning side bet from the coin tray to the second color side bet spot;

if the selected hand is the Banker hand and the selected color is red, then responsive to the number of red cards in the Banker hand exceeding the number of red cards in the Player hand, dispensing a payout associated with a winning side bet from the coin tray to the third color side bet spot; and if the selected hand is the Banker hand and the selected color is black, then responsive to the number of black cards in the Banker hand exceeding the number of black cards in the Player hand, dispensing a payout associated with a winning side bet from the coin tray to the fourth color side bet spot.

8. An electronic gaming machine configured to implement a virtual baccarat game, the electronic gaming machine comprising:

a housing;

a display device supported by the housing;

a plurality of input devices supported by the housing, the plurality of input devices including:

a credit meter configured to store a credit balance;

a payment acceptor configured to receive a payment associated with a monetary value and increment the credit balance on the credit meter;

a cashout device configured to receive an input to cause an initiation of a payout of an amount from the credit balance on the credit meter;

a processor communicatively coupled to a memory which stores a plurality of instructions, which when executed by the processor, cause the processor to operate with the memory, display device and the plurality of input devices to:

store in the memory a representation of each of a plurality of playing cards, each playing cards having a color from the plurality of card colors;

store in the memory a paytable defining payouts for a plurality of different color side bets, each color side bet comprising a combination of a color from the plurality of card colors, and a selection of one of a Player hand or a Banker hand as a selected hand;

receive, via an input to the gaming machine, a selection of a color side bet from among the plurality of color side bets and amount wagered on the color side bet, and decrement the credit meter by the amount wagered on the color side bet;

deal the Player hand and the Banker hand according to standard baccarat rules, by randomly selecting the representation of playing cards from the memory using a pseudorandom number generator, and display the Player hand and the Banker hand on the display device;

determine an outcome of the color side bet, using program code according to:

if the selected hand has a greater number of cards of the selected color than an opposing hand, then the outcome is the color side bet is won; and if the selected hand has a lesser number of cards of the selected color than the opposing hand, then the outcome is the color side bet is lost;

responsive to the outcome of the color side being won, determine an amount of a payout from the payout table stored in the memory, and increment the credit balance on the credit meter by the amount of a payout;

determine whether a winning hand in the baccarat game is either the Player hand or the Banker hand;

determine whether the winning hand is the same as the selected hand;

responsive to the winning hand not being the same as selected hand, determining that a gambler has lost the color side bet.

9. The electronic gaming machine of claim 8, wherein the plurality of instructions further cause the processor to:

display on the display device graphical representations of:

a first color side bet spot for a side bet that the Player hand will have more red cards than the Banker hand after the baccarat game;

a second color side bet spot for a side bet that the Player hand will have more black cards than the Banker hand after the baccarat game;

a third color side bet spot for a side bet that the Banker hand will have more red cards than the Player hand after the baccarat game; and a fourth color side bet spot for a side bet that the Banker hand will have more black cards than the Player hand after the baccarat game;

the paytable indicating the payout for each of the color side bets according to the paytable stored in the memory; and receive the selection of the color side bet from a designation of one of the graphical representations of the color side bet spots.

* * * * *